US005274922A

United States Patent [19]

Elliott

[11] Patent Number: 5,274,922

[45] Date of Patent: Jan. 4, 1994

[54] SHAVING RAZOR

[76] Inventor: Michael F. Elliott, 1335 Megan Pl., Rohnert Park, Calif. 94928

[21] Appl. No.: 942,933

[22] Filed: Sep. 10, 1992

[51] Int. Cl.[5] ..... B26B 21/00; B26B 21/16

[52] U.S. Cl. ..... 30/47; 30/41

[58] Field of Search ..... 30/32, 41, 47, 222, 30/224, 30, 31

[56] References Cited

U.S. PATENT DOCUMENTS

| | | | |
|---|---|---|---|
| 1,701,036 | 2/1929 | Greene | 30/47 |
| 3,492,723 | 2/1970 | Mollica et al. | 30/47 |
| 3,750,280 | 8/1973 | LePaliscot et al. | 30/47 |
| 4,875,287 | 10/1989 | Creasy | 30/41 |
| 4,944,090 | 7/1990 | Sumnall | 30/41 |
| 5,033,191 | 7/1991 | Nauheimer | 30/47 |

*Primary Examiner*—Douglas D. Watts
*Assistant Examiner*—Paul M. Heyrana
*Attorney, Agent, or Firm*—Larry D. Johnson

[57] ABSTRACT

A shaving razor comprising a razor head or blade holding compartment, an elongate planar body portion, and a perpendicular tab portion. This structure allows the thumb and fingers of a user's hand to grasp the razor by the perpendicular tab portion and against the planar body portion; or the perpendicular tab portion to be grasped between the user's extended fingers, and the planar body portion to be grasped between those fingers and the user's thumb. The perpendicular tab portion may be foldable against the planar body portion for compactness in storage and transport.

5 Claims, 6 Drawing Sheets

SHAVING RAZOR

BACKGROUND OF THE INVENTION

1. Field of the Invention

This invention relates generally to shaving implements, and more specifically to an improved shaving razor structure.

2. Description of the Prior Art

Shaving razors are well known, and typically include a shaving head attached to a handle for grasping by the user's hand. Such a configuration, while acceptable, does not provide a structure that lends itself to an ideal shaving technique with the user's thumb and fingers comfortably grasping the razor. In addition, known shaving razor structures are not particularly conducive to compact storage.

Some prior art devices have attempted to address these issues. For example, Foltis U.S. Pat. No. 2,534,861 discloses a foldable safety razor with a back surface that can be grasped between a user's thumb and forefinger. However, such a structure still does not allow for a comfortable grip, nor does it enable the user to control and prevent pivoting of the razor body. Other patents, such as Christmas U.S. Pat. No. 1,875,990, describe a folding-type razor body, although the resultant erected structure is still not conducive for the desired grasping purposes.

SUMMARY OF THE INVENTION

The shaving razor of this invention provides an improved structure for a personal safety razor enabling comfortable grasping by the user, and a low profile design. The inventive structure comprises a razor head or blade holding compartment affixed to the underside surface of an elongate planar body portion, and a perpendicular tab portion affixed to the upper surface of the planar body portion. This structure allows the thumb and fingers of a user's hand to grasp the razor by the perpendicular tab portion and against the elongate planar body portion; or the perpendicular tab portion to be grasped between the user's extended fingers, and the elongate planar body portion to be grasped between those fingers and the user's thumb. The inventive razor's perpendicular tab portion may be foldable against the elongate planar body portion for compactness in storage and transport.

The inventive device may be made of paper, plastic, or any other suitable (and preferably inexpensive) material. The device may include an integral package of shaving gel, preferably installed on the elongate planar body portion underside surface. The device utilizes a more or less standard razor head which is bonded to one end of the elongate planar body portion underside surface, and may even allow for periodic replacement of the razor blades.

BRIEF DESCRIPTION OF THE DRAWINGS

FIG. 4*a* is a plan view of a single piece of material as cut to form the two-piece version and illustrating the elongate planar body portion center line and perpendicular tab portion fold lines;

FIG. 4*b* is a perspective view illustrating the folding process;

FIG. 4*c* is an end elevation view illustrating the completed folding; and

FIG. 4*d* is a perspective view of the completed two-piece version with a razor head attached;

FIG. 5*a* is a perspective view of the rigid version;

FIG. 5*b* is an end elevation view of the rigid version; and

FIG. 5*c* is a side elevation view illustrating the perpendicular tab portion gripping surface;

FIG. 6*a* is a perspective view illustrating the placement of the gel-pack on the elongate planar body portion underside surface; and FIG. 6*b* is a side elevation view illustrating the gel-pack as bonded in place.

DETAILED DESCRIPTION OF A PREFERRED EMBODIMENT

Figure 1A:
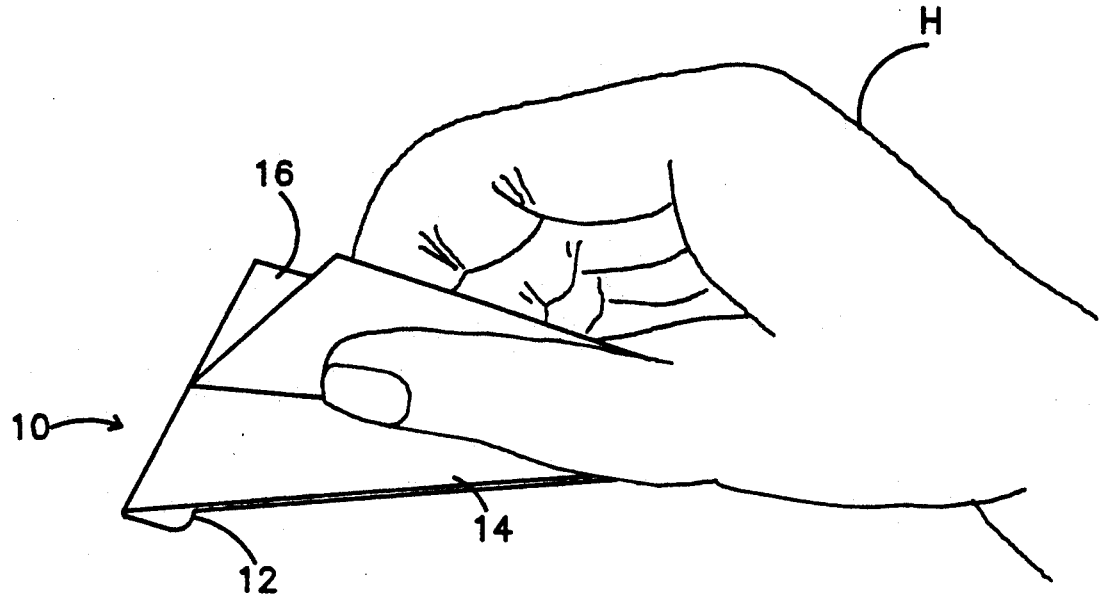
Fig. 1*a* is a perspective view of an improved shaving razor of this invention illustrating the razor head or blade holding compartment, elongate planar body portion, and perpendicular tab portion, this view further illustrating the thumb and fingers of a user's hand grasping the shaving razor by the perpendicular tab portion and against the elongate planar body portion.

Fig. 1*a* is a perspective view of an improved shaving razor 10 of this invention illustrating a razor head or blade holding compartment 12, an elongate planar body portion 14, and a perpendicular tab portion 16. This view further illustrates the thumb and fingers of a user's hand H grasping the shaving razor by the perpendicular tab portion and against the elongate planar body portion. Pivoting of the razor in use is prevented by the user's thumb and fingers against the elongate planar body portion.

Figure 1B:
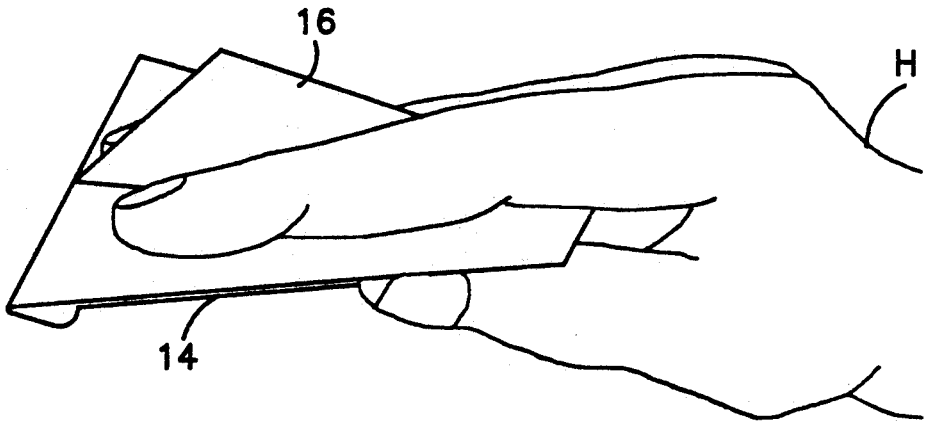
Fig. 1*b* is a perspective view of the improved shaving razor of FIG. 1 illustrating an alternate grasping method, with the perpendicular tab portion as grasped between the user's extended fingers, and the elongate planar body portion as grasped between those fingers and the user's thumb.

Fig. 1*b* is a perspective view of the improved shaving razor of FIG. 1 illustrating an alternate grasping method, with the perpendicular tab portion 16 as grasped between the user's extended fingers, and the elongate planar body portion 14 as grasped between those fingers and the user's thumb. Here, pivoting is prevented by capture of the elongate planar body portion between the thumb and fingers.

Figure 2:
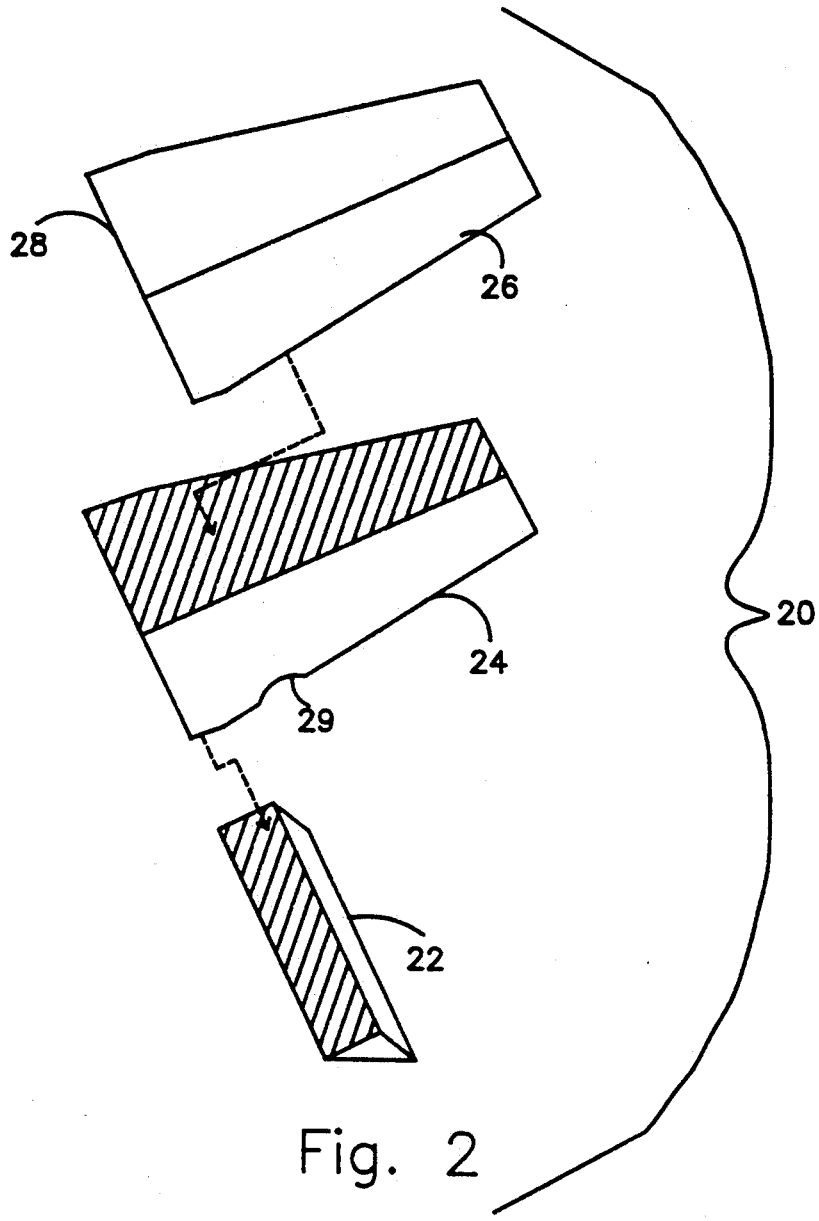
FIG. 2 is an exploded perspective view of the component parts of a three-piece version of the improved shaving razor of this invention, shown aligned for assembly.

FIG. 2 is an exploded perspective view of the component parts of a three-piece version 20 of the improved shaving razor of this invention, shown aligned for assembly. Razor head 22 is affixed to one end of elongate planar body portion 24, while perpendicular tab portion 26 includes a base portion 28 which is glued or otherwise bonded to one side of planar body 24. Small cutout 29 may be included in one edge of the planar body, for ease in folding or erecting the perpendicular tab portion (as illustrated infra).

Figure 3A:
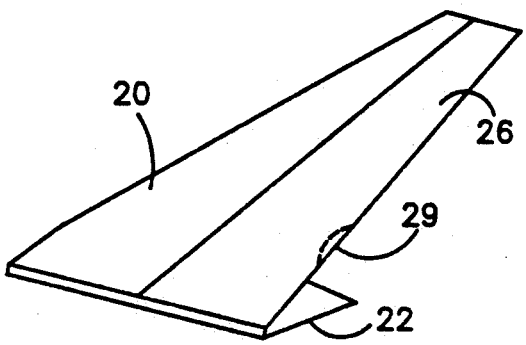
FIG. 3*a* is a perspective view of the three-piece version of the improved shaving razor of FIG. 2 in its flattened configuration for storage.
Figure 3B:
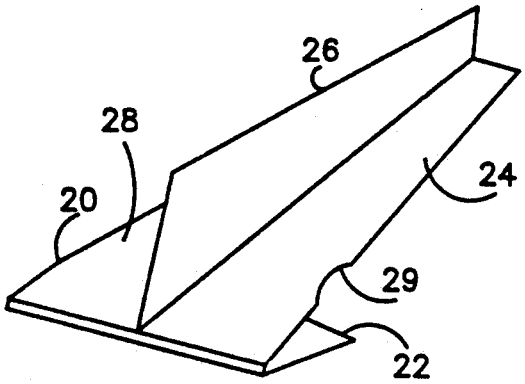
FIG. 3*b* is a perspective view of the three-piece version of FIG. 2 in its erected configuration for use.

FIG. 3*a* is a perspective view of the three-piece version of the improved shaving razor 20 of FIG. 2 in its flattened configuration for storage, while FIG. 3*b* is a perspective view of the razor in its erected configuration for use. These views illustrate the simple folding procedure, enabling the device to be easily and quickly stored when not in use.

Figure 4A:
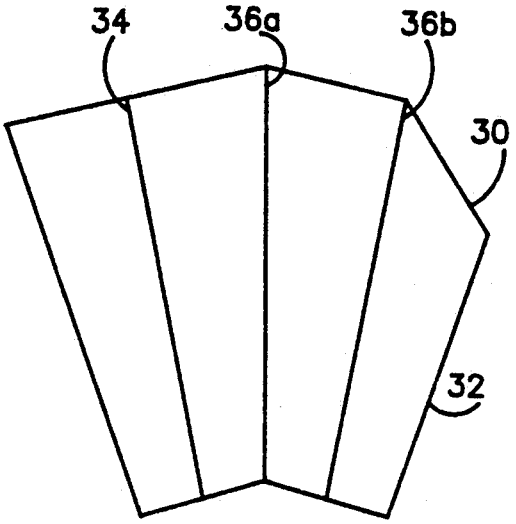
FIGS. 4*a–d* are a series of views of a two-piece version of the improved shaving razor of this invention.
Figure 4B:
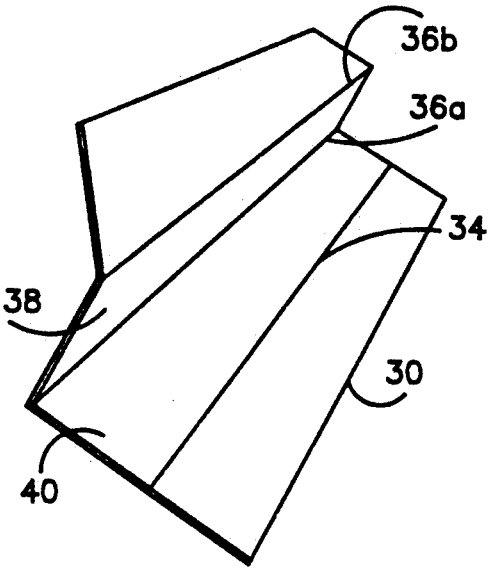
Figure 4C:
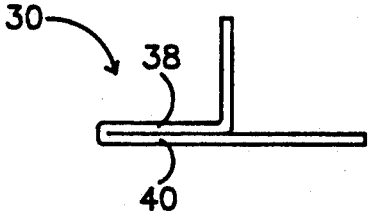
Figure 4D:
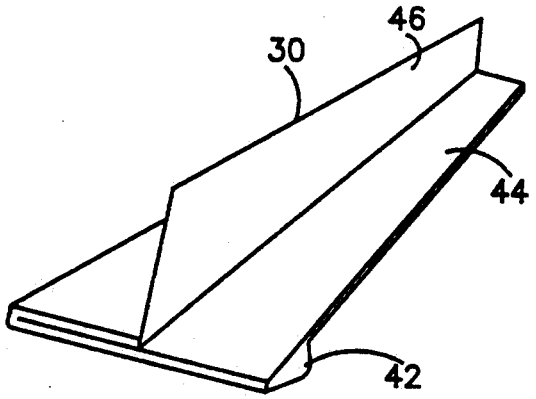

FIGS. 4*a–d* are a series of views of a two-piece version 30 of the improved shaving razor of this invention. FIG. 4*a* is a plan view of a single piece of material 32 as cut to form the two-piece version, and illustrates the elongate planar body portion centerline 34 and perpendicular tab portion fold lines 36*a*, 36*b*. FIG. 4*b* is a perspective view illustrating the folding process, and FIG. 4*c* is an end elevation view illustrating the completed folding, with subpanel 38 preferably glued or otherwise affixed to subpanel 40. FIG. 4*d* is a perspective view of the completed two-piece version with a razor head 42 attached to one end of the underside surface of the elongate planar body portion 44. Perpendicular tab portion 46 is thus foldable against the body portion 44 to achieve the desired compact configuration.

Figure 5A:
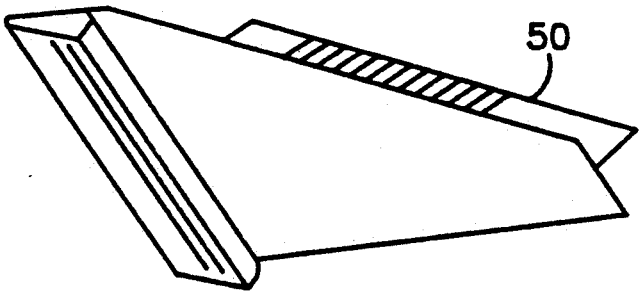
FIGS. 5*a–c* are a series of views of a non-folding (rigid) version of the improved shaving razor of this invention.
Figure 5B:
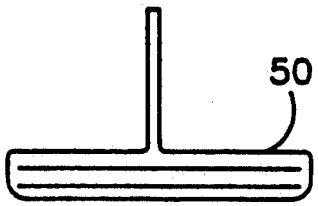
Figure 5C:
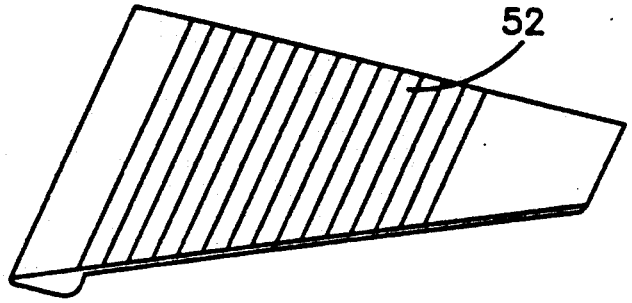

FIGS. 5*a–c* are a series of views of a non-folding (rigid) version 50 of the improved shaving razor of this invention. FIG. 5*a* is a perspective view of the rigid version 50, FIG. 5*b* is an end elevation view, and FIG. 5*c* is a side elevation view illustrating the perpendicular tab portion gripping surface 52. While not foldable (collapsible) this version may be more desirable in some applications as a more permanent embodiment.

Figure 6A:
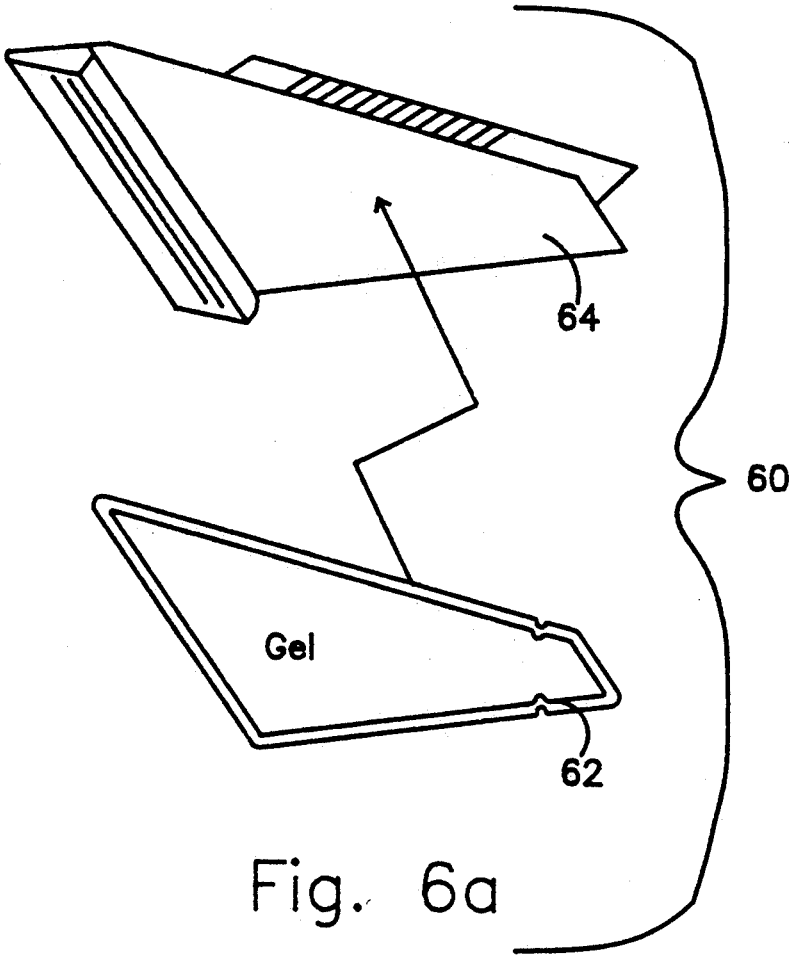
FIGS. 6*a–b* are a pair of views illustrating an incorporated gel-pack embodiment of the improved shaving razor of this invention.
Figure 6B:
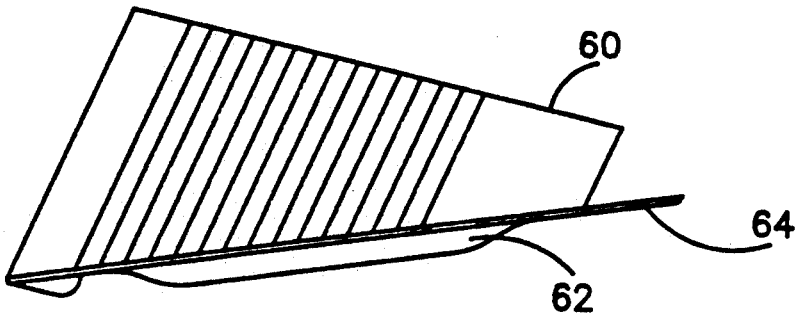

FIGS. 6*a–b* are a pair of views illustrating an incorporated shaving gel-pack embodiment 60 of the improved shaving razor of this invention. FIG. 6*a* is a perspective view illustrating the placement of the shaving gel-pack 62 on the elongate planar body portion 64 underside surface, while FIG. 6*b* is a side elevation view illustrating the gel-pack 62 as bonded in place.

Figure 7:
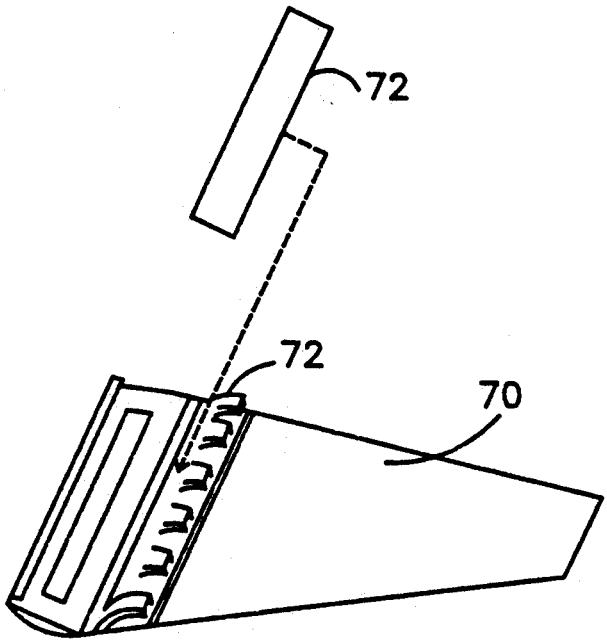
FIG. 7 is an exploded perspective view of a replaceable-blade version of the improved shaving razor of this invention.

FIG. 7 is an exploded perspective view of a replaceable-blade version 70 of the improved shaving razor of this invention. Here, razor head 72 can be opened to accept replacement razor blades 74, in the traditional manner.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A shaving razor structure comprising:

an elongate planar body portion having a top surface, bottom surface, and centerline;

a tab portion affixed to and perpendicular to said elongate planar body portion top surface along said centerline; wherein said perpendicular tab portion is foldable against said elongated planar body portion a blade holding compartment affixed to said elongate planar body portion bottom surface.

2. The shaving razor of claim 1 including an integral package of shaving gel installed on said elongate planar body portion underside surface.

3. The shaving razor of claim 1 wherein said blade holding compartment enables replacement of razor blades.

4. The shaving razor of claim 1 wherein said elongate planar body portion and said perpendicular tab portion are formed from a single piece of folded material.

5. The shaving razor of claim 1 wherein said perpendicular tab portion includes a gripping surface.

* * * * *